US009768506B2

(12) United States Patent
Krogerus

(10) Patent No.: US 9,768,506 B2
(45) Date of Patent: Sep. 19, 2017

(54) MULTI-ANTENNNA ISOLATION ADJUSTMENT

(71) Applicant: Microsoft Technology Licensing, LLC, Redmond, WA (US)

(72) Inventor: Joonas Krogerus, Espoo (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 72 days.

(21) Appl. No.: 14/854,353

(22) Filed: Sep. 15, 2015

(65) Prior Publication Data

US 2017/0077603 A1 Mar. 16, 2017

(51) Int. Cl.

| | |
|---|---|
| ***H01Q 1/24*** | (2006.01) |
| ***H01Q 5/30*** | (2015.01) |
| ***H01Q 5/10*** | (2015.01) |
| ***H01Q 1/38*** | (2006.01) |
| ***H01Q 1/50*** | (2006.01) |
| ***H01Q 5/328*** | (2015.01) |
| ***H01Q 1/42*** | (2006.01) |
| ***H01Q 1/52*** | (2006.01) |
| ***H01Q 13/10*** | (2006.01) |
| ***H01Q 21/28*** | (2006.01) |

(52) U.S. Cl.

CPC ..... *H01Q 5/30* (2015.01); *H01Q 1/24* (2013.01); *H01Q 1/243* (2013.01); *H01Q 1/38* (2013.01); *H01Q 1/42* (2013.01); *H01Q 1/50* (2013.01); *H01Q 1/52* (2013.01); *H01Q 5/10* (2015.01); *H01Q 5/328* (2015.01); *H01Q 13/10* (2013.01); *H01Q 21/28* (2013.01)

(58) Field of Classification Search

CPC ..... H01Q 13/10; H01Q 1/243; H01Q 5/35; H01Q 5/357

See application file for complete search history.

(56) References Cited

U.S. PATENT DOCUMENTS

| | | | |
|---|---|---|---|
| 7,245,259 | B2 | 7/2007 | Puckey et al. |
| 7,893,889 | B2 | 2/2011 | Proctor et al. |
| 8,570,229 | B2 | 10/2013 | Yoon et al. |

(Continued)

FOREIGN PATENT DOCUMENTS

| | | | |
|---|---|---|---|
| EP | 0716786 | A1 | 6/1996 |
| WO | 2014106440 | A1 | 7/2014 |

OTHER PUBLICATIONS

"International Search Report and Written Opinion Issued in PCT Application No. PCT/US2016/045666", Mailed Date: Nov. 7, 2016, 16 Pages.

Zhong, et al., "Multiband Slot Antennas for Metal Back Cover Mobile Handsets", In Proceedings of Progress in Electromagnetics Research Letters, vol. 39, Apr. 23, 2015, pp. 115-126.

(Continued)

*Primary Examiner* — Hoang Nguyen

(57) ABSTRACT

In an embodiment, isolation between antennas of a multi antenna system is disclosed. According to another embodiment, a device is disclosed comprising a conductive portion of a cover of the device; a first antenna feed configured to a first radio frequency band; a second antenna feed configured to a second radio frequency band; at least two slots of a printed wiring board, feeds being coupled to the slots and slots being coupled to the conductive portion; a first capacitive component; a second capacitive component; wherein the first and the second capacitive component are configured between the printed wiring board and the conductive portion.

20 Claims, 10 Drawing Sheets

(56) References Cited

U.S. PATENT DOCUMENTS

| | | | | |
|---|---|---|---|---|
| 8,629,813 | B2 | 1/2014 | Milosavljevic | |
| 8,665,164 | B2 | 3/2014 | Hill et al. | |
| 8,773,317 | B2 | 7/2014 | Sakata et al. | |
| 8,816,921 | B2 | 8/2014 | Ayatollahi | |
| 8,854,266 | B2 | 10/2014 | Zhu et al. | |
| 8,907,850 | B2 | 12/2014 | Schlub et al. | |
| 8,907,852 | B2 | 12/2014 | Hill et al. | |
| 9,041,606 | B2 * | 5/2015 | Faraone | H01Q 1/243 343/702 |
| 9,236,659 | B2 * | 1/2016 | Vazquez | H01Q 13/103 |
| 2010/0117908 | A2 | 5/2010 | Lee et al. | |
| 2011/0006965 | A1 | 1/2011 | Kits van Heyningen | |
| 2012/0068902 | A1 | 3/2012 | Clow et al. | |
| 2013/0050031 | A1 | 2/2013 | Zhu et al. | |
| 2013/0135158 | A1 | 5/2013 | Faraone et al. | |
| 2013/0229317 | A1 | 9/2013 | Mumbru et al. | |
| 2013/0257668 | A1 | 10/2013 | Rao et al. | |
| 2014/0062801 | A1 | 3/2014 | Yong et al. | |
| 2014/0125528 | A1 | 5/2014 | Tsai et al. | |
| 2014/0266938 | A1 | 9/2014 | Ouyang et al. | |
| 2014/0266941 | A1 | 9/2014 | Vazquez et al. | |
| 2014/0292593 | A1 | 10/2014 | Thiam et al. | |
| 2015/0048979 | A1 | 2/2015 | Asrani et al. | |

OTHER PUBLICATIONS

"Lite-On Mobile Launches Fumod, an Innovative Antenna Solution for Metal Handheld Devices", Published on: May 15, 2015 Available at: http://www.liteonmobile.com/news/lite-on-mobile-launches-antenna-solution-for-metal-handheld-devices.

Zhang, Shuai, "Investing and Enhancing Performance of Multiple Antenna System in Compact MIMO/Diversity Terminal", In Doctoral Thesis, Jan. 2013, 74 pages.

Cihangir, Aykut, "Antenna Designs using Matching Circuits for 4G Communicating Devices", In Doctoral Thesis, Apr. 23, 2015, 144 pages.

Addaci, et al., "Design of Multi-Antenna System for UMTS Clamshell Mobile Phones with Ground Plane Effects Considerations", In Proceedings of Radio Engineering, vol. 23, No. 2, Jun. 2014, pp. 724-732.

"Cell Phone Antenna Design", Published on: Jun. 29, 2013 Available at: http://www.antenna-theory.com/design/cellantenna.php.

Anguera, et al., "Advances in Antenna Technology for Wireless Handheld Devices", In International Journal of Antennas and Propagation, vol. 2013, Jan. 2013, 26 pages.

Ito, et al., "Design of a Metal Cap with Two Slots Covering the end of a Module Substrate for 60-GHz WPAN", In Proceedings of IEEE International Workshop on Electromagnetics, Aug. 4, 2014, pp. 50-51.

* cited by examiner

MULTI-ANTENNNA ISOLATION ADJUSTMENT

BACKGROUND

Different types of wireless mobile communication devices may have multi-antenna systems. Devices, employing multiple antennas at both the transmitter and receiver, may offer increased capacity and enhanced performance for communication systems, possibly without the need for increased transmission power. Limited space in the enclosure of a device, however, may need to be considered in designing such multiple antenna assemblies. An antenna may be compact to occupy relatively small amount of space.

Furthermore, since the multiple antennas may be located close to each other, strong mutual coupling may occur between them, which can distort the radiation patterns of each antenna and degrade system performance, for example, causing an antenna element to radiate or receive an unwanted signal. A metal cover of the device may increase the undesired electromagnetic coupling between the antennas.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

In an embodiment, a device is disclosed comprising: at least one conductive portion of a cover of a device; a first antenna feed configured to a first radio frequency band; a second antenna feed configured to a second radio frequency band; at least two slots on a printed wiring board, feeds being coupled to the slots and slots to the conductive portion;

a first capacitive component; a second capacitive component; wherein the first and the second capacitive component are configured between the printed wiring board and the conductive end portion.

Other embodiments relate to a mobile device and a manufacturing method.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like references are used to designate like parts in the accompanying drawings.

DETAILED DESCRIPTION

The detailed description provided below in connection with the appended drawings is intended as a description of the present embodiments and is not intended to represent the only forms in which the present embodiment may be constructed or utilized. However, the same or equivalent functions and sequences may be accomplished by different embodiments.

Although the present embodiments may be described and illustrated herein as being implemented in a smartphone or a mobile phone, these are only examples of antenna isolation and not a limitation. The present embodiments are suitable for application in a variety of different types of devices, for example, in tablets, phablets, computers, cameras, game consoles, small laptop computers, smart watches, wearable devices or any other device that has a need for and/or may benefit from multiple high frequency antennas.

The phrases "conductive cover portion" and "portion of a conductive cover" are used interchangeably in the following description. According to an embodiment, they may encompass portions of a device cover, the device cover being conductive or at least the cover portion or part of the cover portion being conductive.

Figure 1:
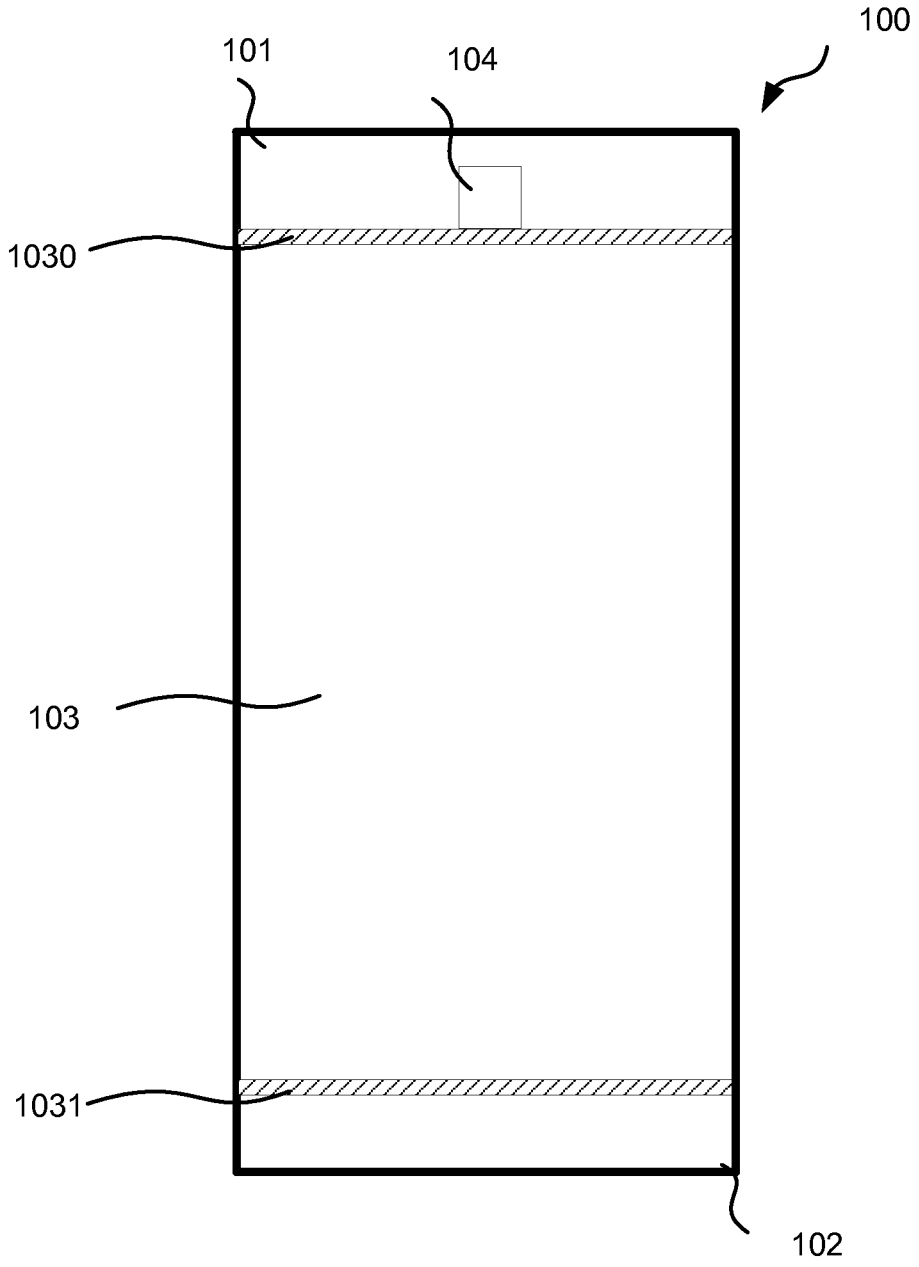
FIG. 1 illustrates a schematic representation of posterior side of a mobile device with a conductive cover according to an embodiment.

FIG. 1 is a schematic illustration of a rear/posterior view of a mobile device 100 according to an embodiment. The device 100 may have a conductive cover 103 comprising a top conductive portion 101 and a bottom conductive portion 102. The device 100 may have at least one window for a component 104 exposed through the conductive cover. Typically the cover may comprise a gap (slit) 1030 between the top conductive portion 101 of the cover and the rest of the cover 103. Further, the cover may comprise a gap 1031 between the bottom conductive portion 102 and rest of the cover 103.

Figure 2:
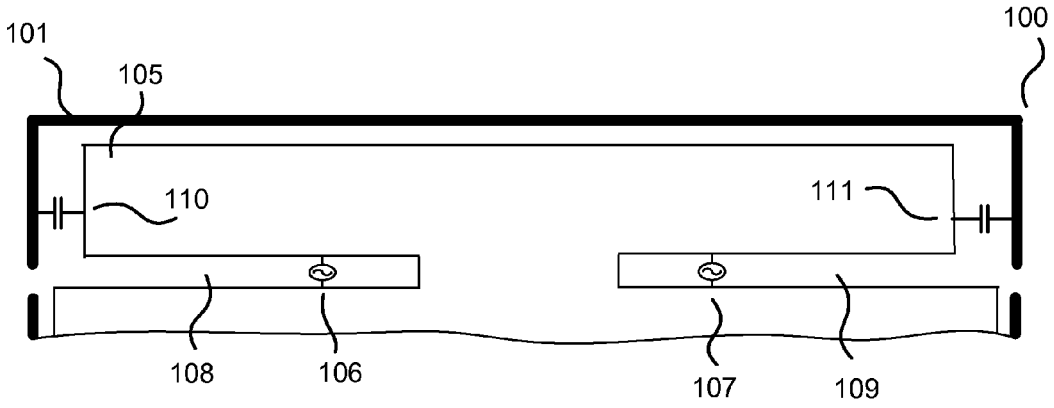
FIG. 2 illustrates a schematic representation of a section of a mobile device comprising two antenna feeds and two capacitive components according to an embodiment.

FIG. 2 is a schematic illustration of a section of a mobile device 100 according to an embodiment. It may include a printed wire board (PWB) 105, a portion 101 of a conductive cover, antenna feeds 106, 107, slots 108, 109 in the PWB and capacitive components 110, 111.

Although the present embodiments use the phrase "printed wire board (PWB)", it is for illustrative purposes only and not intended as a limitation in any way. According to an embodiment the PWB may include various structures that may mechanically support and/or electrically connect electric and electronic components, for example, Printed Circuit Board (PCB), Printed Circuit Assembly (PCA), Printed Circuit Board Assembly (PCBA), Circuit Card Assembly (CCA), Flexible Printed Circuit (FPC) etc.

Referring to an embodiment as illustrated in FIG. 2, PWB 105 may be a support structure to which various electronic and electrical components (not illustrated in FIG. 2) of a mobile device 100 are attached. These components may be, for example, camera modules, microphones, LEDs, Sensors etc. which are exposed to the exterior through the conductive cover 103. The components may also be, for example, the processor, GPU, digital signal processor, USB port, connectivity port, charging port etc., which are either hidden or partially exposed to the exterior through a conductive cover 103 or sides of a device 100. According to an embodiment, PWB 105 may comprise of multiple layers, some of which may be conductive. A PWB 105 may have two antenna feeds 106, 107 to enable a mobile device 100 to communicate. Antenna feeds 106, 107 may be coupled to slots 108, 109 in a PWB 105. In an embodiment, slots 108, 109 may form a T shaped dual slot. Further, slot 108 may be less than or greater than or equal in length to the slot 109. The respective dimensions and relative placement of slots 108, 109 may depend upon various factors and constraints, for example, frequency, size, available space etc. Capacitive components 110, 110 may be configured between a PWB 105 and a portion 101 of a conductive cover 103. In an embodiment, capacitive components 110, 111 may be configured at the lateral extremities of the PWB 105. In an embodiment, the capacitive components 110,111 may be configured at the lateral extremities of the PWB 105, substantially close to the open ends of slots 108, 109. In an embodiment, a conductive cover portion 101 is an end cap. In an embodiment, a conductive cover portion 101 comprises a top end cap of a device 100. In another embodiment, a conductive cover portion 101 comprises a bottom end cap of a device 100. According to an embodiment, end cap may encompass portions of a cover 103 of a device 100 which are configured to cover a device 100 near its edges. It includes portions which may comprise a canopy, said canopy extending from an edge, towards the general backside of a device.

Referring to an embodiment illustrated in FIG. 2, the capacitance of capacitive component 110 may be less than, greater than or equal to that of another capacitive component 111. The capacitance, configuration and location of the capacitive components 110, 111 with respect to open ends of the slots 108, 109 may depend upon various factors like frequency of corresponding antenna feed 108,109, size and available space, design of PWB 105, relative permittivity of a material comprising PWB 105, design of a conductive cover portion 101, size of the device 100, etc. In an embodiment, the capacitance of capacitive components 110, 111 may be of the order of a few picofarads. In an embodiment, either capacitive component 110 or capacitive component 111 or both may be discrete capacitors. In some other embodiments, either capacitive element 110 or the capacitive element 111 or both may comprise structural elements of either a conductive portion 101 or a PWB 105 or both. In another embodiment, either of the capacitive components 110,110 or both may comprise a combination of a discrete capacitor and structural elements of either a PWB 105, a conductive cover portion 101 of a conductive cover 103 or both a PWB 105 and a conductive cover portion 101.

Referring to an embodiment illustrated in FIG. 2, antenna feeds 106, 107 may electromagnetically couple with slots 108 and 109 respectively. This configuration may comprise two slot antennas. Slot antennas may use a slot in a surface as a radiating and/or receiving element of an antenna. In an embodiment, antenna feeds 106, 107 may be configured for the same frequency band. In another embodiment, antenna feeds 106, 107 may be configured for different frequency bands. According to an embodiment, at least one of feeds 106,107 and its corresponding slot 108, 109 may be configured for a frequency range or a part thereof selected from at least one of: 698-960 MHz, 1.71 to 2.17 GHz, and 2.3 to 2.7 GHz. These frequency ranges may be called LTE Low Band (698-960 MHz), LTE Medium Band (1.71 to 2.17 GHz) and LTE High Band (2.3 to 2.7 GHz) respectively in the relevant literature. According to an embodiment, Long Term Evolution standard (LTE) is applied. In an embodiment, at least one of antenna feeds 106,107 may be configured for frequencies in frequency ranges designated for GPS, GLONASS, BeiDou, Galileo, Wi-Fi, Wireless LAN, WiMAX, or any of the various non-cellular wireless systems, etc. Conductive cover portion 101 may increase electromagnetic coupling between the two antennas feeds 106, 107. In an embodiment, a device 100 may include a switch (not illustrated in FIG. 2) between the two antenna feeds 106, 107, which may allow the device 100 to dynamically use either one of the antenna feeds 106,107. Capacitive components 110, 111 may decrease coupling between antenna feeds 106,107 caused by a conductive cover portion 101. Capacitive components 110, 111 may be adjusted to manipulate the electromagnetic isolation between antenna feeds 106,107.

Referring to an embodiment illustrated in FIG. 2, capacitive components 110,111 may reduce mutual coupling between two antennas which may comprise the antenna feeds 106, 107 and the slots 108,109 respectively. In an embodiment, capacitive elements 110 and 111 may be adjusted to configure the lower and higher cutoff frequencies of an isolation band between the antenna feeds 106,107. In an embodiment, antenna feeds 106,107 may provide 2nd order diversity. Antenna diversity schemes may improve performance and reliability of wireless links by employing multiple co-located antennas. In an embodiment, device 100 may include more than one cover portions and corresponding slot and antenna feed pairs and enable $4^{th}$ order, $6^{th}$ order or higher order diversity antenna feeds. In an embodiment, antenna feeds 106,107 may be configured for receive (Rx) diversity. In another embodiment, antenna feeds 106,107 may be configured for transmit (Tx) diversity. In an embodiment, antenna feeds 106,107 and slots 108, 109 may be configured for Multiple Input Multiple Output (MIMO) operation. MIMO operation in radio communication may improve capacity of a wireless link. MIMO may require multiple antennas in some cases, for example, in single user MIMO. The terms used herein are standard in academia or industry and are used for illustration purposes only, and instead of standardized terms and functions other embodiments may be applicable having similar features and/or functions.

Figure 3:
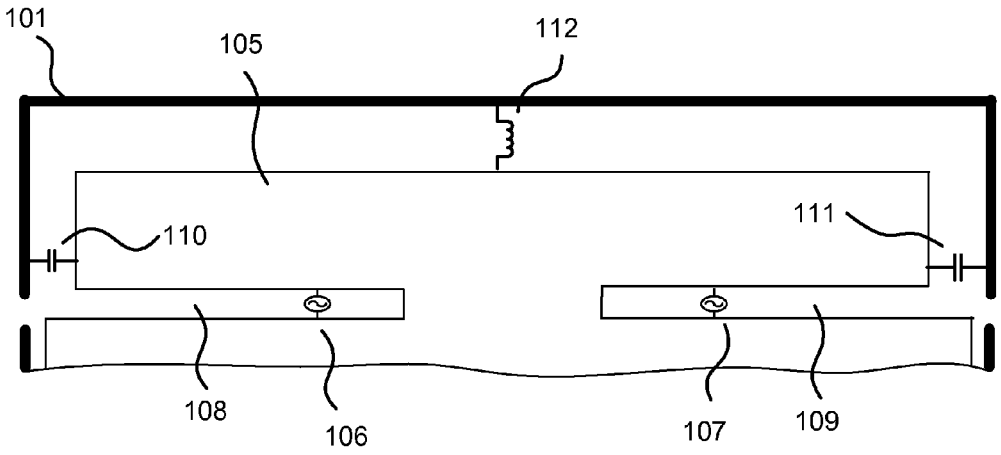
FIG. 3 illustrates a schematic representation of a section of a mobile device comprising, two antenna feeds, two capacitive components and an inductive component according to an embodiment.

FIG. 3 shows an illustration of a section of a mobile device 100 according to an embodiment. A device 100 may comprise a printed wire board (PWB) 105, a portion 101 of a conductive cover, antenna feeds 106, 107 configured on a PWB 105, slots 108, 109 in PWB 105; capacitive components 110, 111 and an inductive component 112.

Referring to an embodiment illustrated in FIG. 3. A device 100 includes a printed wiring board PWB 105. In an embodiment, at least one electronic component (not illustrated in FIG. 3) may be configured on the PWB. In an embodiment, at least one of the components configured on the PWB may be exposed partially or wholly through the conductive portion of the cover 101 or a lateral or vertical side of a cover 103. The components may be, for example, a camera, USB port, connectivity or charging port, LED for camera flash, keys/buttons etc. Slots 108 and 109 may be configured in a PWB 105. An antenna feed 106 may be configured to a slot 108 and another antenna feed 107 may be configured to a slot 109. Capacitive components 110, 111 may be configured between the PWB 105 and the conductive cover portion. An inductive component 112 may be configured between a PWB 105 and conductive cover portion 101. In an embodiment, capacitive components 110, 111 may be configured between a PWB 105 and a conductive cover portion 101 at substantially lateral positions. In an embodiment, capacitive components 110, 111 may be configured between a PWB 105 and a conductive cover portion 101 near the open ends of slots 108,109 in a PWB 105. An inductive component 102 may be configured substantially along a longitudinal axis of PWB 105, substantially on an edge of PWB 105 antipodal to slots 108,109.

Referring to an embodiment illustrated in FIG. 3, capacitive components 110,111 and inductive component 112 may be configured to change the isolation between antenna feeds 106, 107 coupled to the same conductive cover portion 101. An inductive component 112 may be adjusted to configure, at least in part, an upper cut-off of an isolation band between two antenna feeds 106,107. In an embodiment, inductive component 112 may provide a grounding point for the conductive cover portion 101 against electrostatic discharge.

Figure 4:
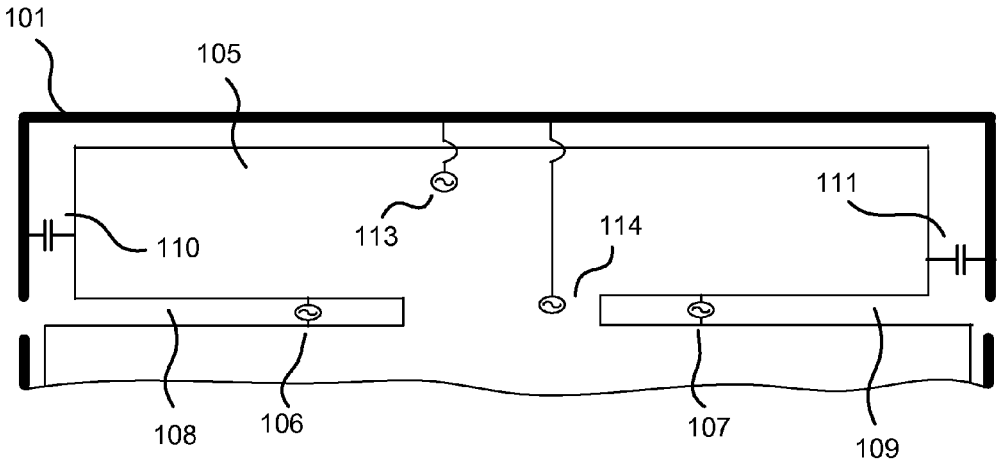
FIG. 4 illustrates a schematic representation of a section of a mobile device comprising two antenna feeds, two capacitive components and an additional antenna feed according to an embodiment.

FIG. 4 is a schematic illustration of a device according to an embodiment. It comprises: a PWB 105, a conductive cover portion 101, slots 108,109 configured in the PWB, antenna feeds 106, 107 configured in slots 108,109 and capacitive elements 110,111 configured between a PWB 105 and a conductive cover portion 101. Further, it may include a third antenna feed 113 configured on the PWB 105. A third antenna feed 113 may be configured for a third frequency band. In an embodiment, feed 113 may be coupled galvanically with a conductive cover portion 101. In an embodiment, feed 113 may be coupled capacitively with a conductive cover portion 101.

Referring to the illustrations in FIG. 4, in an embodiment, all three antenna feeds 106, 107, 113 may be active simultaneously. In another embodiment, their operation may be switched. In an embodiment, third antenna feed 113 may be configured substantially along a longitudinal axis of a PWB 105, substantially on an edge of PWB 105 antipodal to slots 108,109. In an embodiment, the third frequency band may be 698 MHz to 960 MHz. In an embodiment the third frequency band may be configured for operation of at least one of: GPS, GLONASS, BeiDou, Galileo, WIFI, WIMAX etc. Capacitive components 110,111 may be configured to adjust isolation between the signals of at least two of: antenna feed 106, antenna feed 107, and antenna feed 113. According to an embodiment, third antenna feed 113, may increase or improve communication capabilities of a device 100 by making more bandwidth available.

Referring to the illustrations shown in FIG. 4, in an embodiment, a fourth antenna feed 114 may be configured on the PWB. In an embodiment, feed 114 may be coupled galvanically with a conductive cover portion 101. In an embodiment, feed 114 may be coupled capacitively with a conductive cover portion 101. The fourth antenna feed 114 may be configured for a fourth frequency band. In an embodiment the fourth frequency band may be configured for operation of at least one of: GPS, GLONASS, BeiDou, Galileo, WIFI, WIMAX etc. In an embodiment, fourth antenna feed 114 may be configured for frequencies designated for one of the LTE bands. In an embodiment, antenna feed 114 may be configured to operate as an LTE diversity feed configured to operate on the same frequency bands for which antenna feeds 106 and 107 are configured. In embodiment, fourth frequency feed 114 may be configured on the PWB 105 substantially in the middle of slots 108 and 109. Capacitive components 110,111 may be configured to provide isolation between at least two of: antenna feed 106, antenna feed 107, antenna feed 113, and antenna feed 114. According to an embodiment, fourth antenna feed 114 may increase or improve communication of a device 100 by making more bandwidth available. In an embodiment, a third antenna feed 113 or a fourth antenna feed 114 may provide location finding capabilities by providing access to Satellite Navigation Systems like GPS, GLONASS, BeiDou etc.

Figure 5:
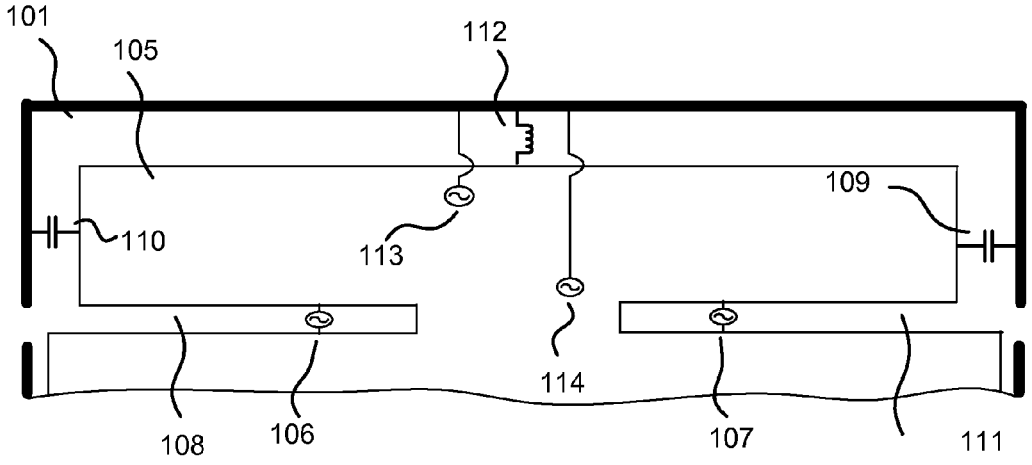
FIG. 5 illustrates a schematic representation of a section of a mobile device comprising two capacitive components, an inductive component and multiple antenna feeds according to an embodiment.

FIG. 5 schematically illustrates an embodiment. It may be similar to an embodiment illustrated in FIG. 4, additionally it may further include an inductive component 112 configured between a conductive cover portion 101 and a PWB 105.

Referring to an embodiment illustrated in FIG. 5 inductive component 112 may be configured to adjust, at least in part, an upper cut-off and a lower cutoff frequency of an isolation band between at least two of antenna feeds 106, 107, and 113. In some embodiments which include a fourth antenna feed 114, inductive component 112 may be configured to adjust, at least in part, the upper cut-off of the isolation band between at least two of antenna feeds 106, 107, 113,114. In an embodiment, inductive component 112 may be configured to provide, at least partial, electrostatic discharge protection to a device 100. According to an embodiment, inductive component 112 may be configured to contribute, at least in part, in impedance matching of antenna feed 113.

Figure 6:
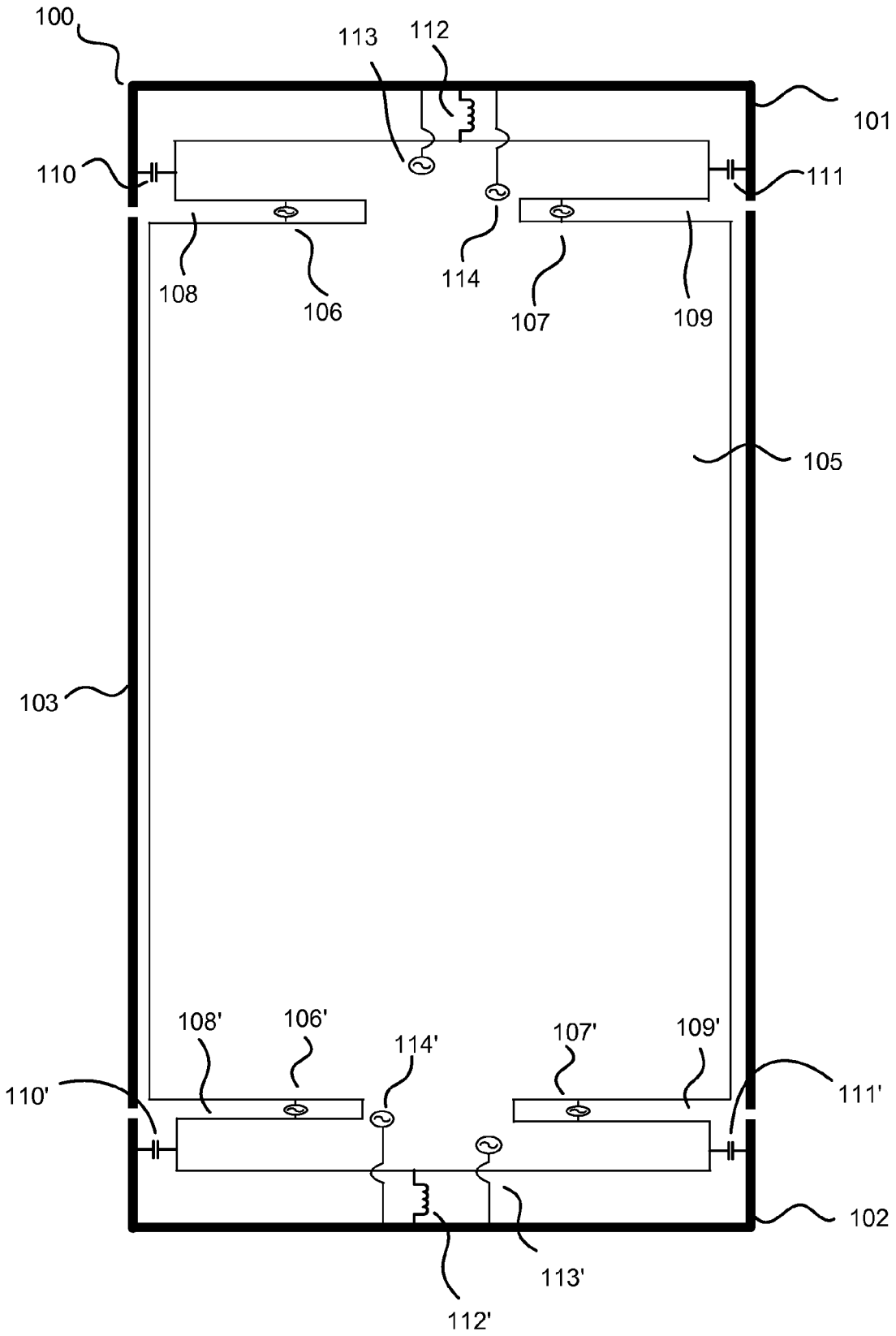
FIG. 6 illustrates a schematic representation of a section of a mobile device comprising multiple conductive cover portions according to an embodiment.

FIG. 6 is a schematic illustration of a section of a device according to an embodiment. A device 100 may comprise a conductive cover 103, a PWB 105; conductive cover 105 may comprise two conductive cover portions 101, 102. A PWB 105 may comprise slots 108,109 configured corresponding to a cover portion 101 and slots 108', 109' configured corresponding to a cover portion 102. Antenna feeds 106,107, 106', 107' may be configured to slots 108,109,108', 109' respectively. Capacitive components 110, 111 may be configured between a PWB 105 and a conductive cover portion 101. Capacitive components 110', 111' may be configured between a PWB 105 and a conductive cover portion 102. In an embodiment, at least one inductive component, inductive component 112 or inductive component 112' may be configured between a PWB 105 and conductive cover portions, conductive cover portion 101 or conductive cover portion 102 respectively. In an embodiment at least one additional antenna feed, antenna feed 113 or antenna feed 114 may be configured on PWB 105. In an embodiment at least one additional antenna feed, antenna feed 113' or antenna feed 114' may be configured on PWB 105. In an embodiment, at least one of the feeds 113, 114, 113', and 114' may be coupled galvanically with their corresponding conductive cover portion 101 or 102.

Referring to the illustrations in FIG. 6, in an embodiment, capacitive components 110, 111 may be configured at substantially lateral positions of PWB 105, between PWB 105 and conductive cover portion 101. In an embodiment, capacitive components 110', 111' may be configured at substantially lateral positions of PWB 105, between PWB 105 and conductive cover portion 102. In an embodiment, capacitive components 110', 111' may be configured between PWB 105 and conductive cover portion 102 at substantially lateral positions of PWB 105, and in substantial proximity of open ends of slots 108, 109, 108', 109' respectively. In embodiments, which comprise at least one inductive component 112,112', the at least one inductive component may be configured between a conductive cover portion 101 or 102 and a PWB 105 substantially close to a longitudinal axis of a PWB 105. In embodiments which comprise at least one additional antenna feed 113,114,113', 114', an additional feed 113,114,113', 114', may be configured in substantial proximity of or along a longitudinal axis of a PWB 105. In an embodiment, at least one of additional feeds 113 and 113' may be configured substantially antipodal to slots 108,109 and 108', 109' respectively. In an embodiment, at least one of additional feeds 114 or 114' may be configured on a lateral axis joining 108 and 109 or 108' and 109' respectively, substantially equidistant from the closed ends of the corresponding slots. In an embodiment, at least one of additional feeds 114 or 114' may be configured on a longitudinal axis of PWB 105, substantially equidistant from the closed ends of the corresponding slots 108 and 109 or 108' and 109'.

Referring to the embodiments illustrated in FIG. 6, capacitive components 110, 111, may be configured to reduce coupling between at least two of the antenna feeds 106,107,113,114 that may be coupled to a conductive cover portion 101. Similarly, capacitive components 110', 111' may be configured to reduce coupling between at least two of antenna feeds 106',107',113',114' that may be coupled to a conductive cover portion 102. In an embodiment, capacitive components 110,111,110', 111', may be configured to adjust an isolation band between at least two antenna feeds 106, 107 coupled to their corresponding conductive cover portion 101 or 102.

Referring to illustrations in FIG. 6, in an embodiment which comprises at least one inductive component 112 or 112' configured between PWB 105 and the corresponding cover portion 101 or 102, the at least one inductive component 112 or 112' may be configured to adjust the upper limit of an isolation band between at least two antenna feeds from: antenna feeds 106,107,113,114 or 106', 107', 113', 114'. In an embodiment, the at least one inductive component 112 or 112' may provide protection against electrostatic discharges by electrically grounding conductive cover portion 101,102 to the PWB 105.

Figure 7:
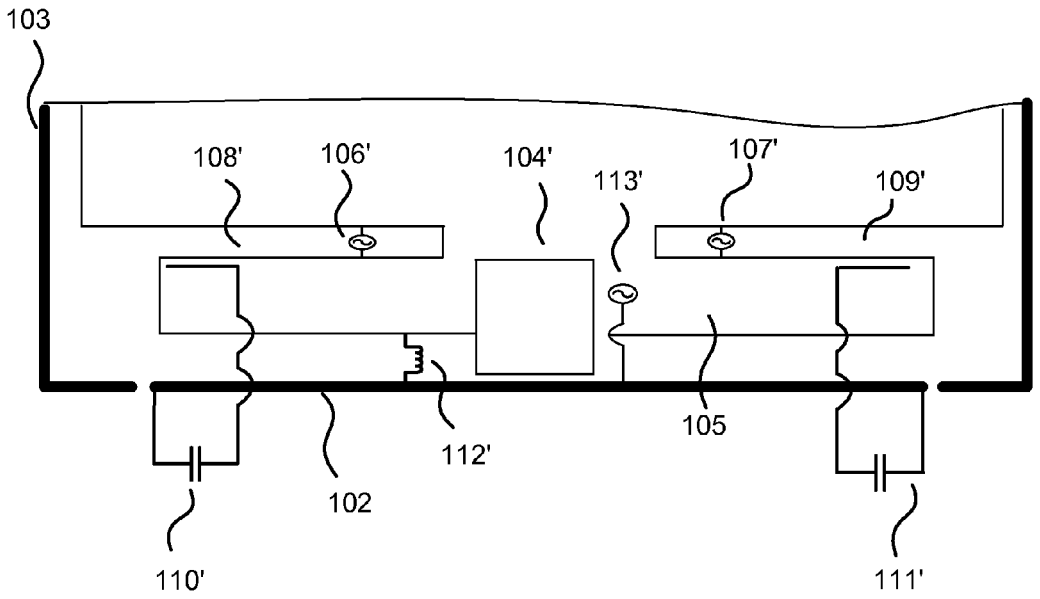
FIG. 7 illustrates a schematic representation of a section of a mobile device according to an embodiment, comprising a conductive cover portion not extending from edge to edge.

FIG. 7 illustrates a view of a section of a device 100 according to an embodiment. It comprises a PWB 105, a conductive cover portion 102, two antenna feeds 106', 107', two capacitive components 110', 111', an inductive component 112', two slots 108', 109' in the PWB 105 and a component 104' configured on the PWB 105. According to an embodiment a conductive cover portion may not extend from one lateral edge to another lateral edge of the device 100. Conductive cover portion 102 may be shaped so that its width is substantially lesser than the width of device 100, and it is surrounded on three sides by the main portion of the conductive cover 103. Consequently, a gap between the conductive cover portion 102 and rest of the conductive cover 103 may not extend from an edge of the device 100 to an opposite edge. Instead the gap may be such that it starts and ends on the same edge. In an embodiment, as exemplarily illustrated in FIG. 7, a dimension of a portion of PWB 105 may be substantially equal to a dimension of conductive cover portion 102 which does not extend from one edge of the device to another, so as to align slots 108', 109' with at least a part of the gap between a conductive cover portion 102 and rest of the cover 103. Capacitive components 110' and 111' may be configured between the PWB 105 and the conductive cover portion 102. In an embodiment, an inductive component 112' may be configured between the PWB 105 and the conductive cover portion 102. In an embodiment, capacitive components 110', 111' are configured between PWB 105 and the conductive cover portion 102 at lateral extremities of the PWB 105, near the open end of slots 108', 109' of the PWB 105. In an embodiment, an inductive component 112, may be configured between the PWB 105 and the conductive cover portion 102 substantially at the center of an edge of PWB 105 antipodal to slots 108',109'. In an embodiment the component 104' may be a charging port, a connectivity port, a hybrid charging and connectivity port, a mini or micro USB port etc. In an embodiment, a third antenna feed 113' may be configured near an edge of the PWB 105 away from slots 108', 109 and substantially along a longitudinal axis of PWB 105. In an embodiment, antenna feed 113' may be galvanically or capacitively coupled with conductive cover portion 102. According to an embodiment, device 100 may include a fourth antenna (not illustrated in FIG. 7). The fourth antenna may be configured substantially along a lateral axis passing through slots 108' and 109'.

Referring to embodiments illustrated in FIG. 7, at least one of the antenna feeds 106' or 107' may be configured for frequency bands corresponding to at least one of: LTE high band, LTE medium band, LTE low band, GPS, GLONASS, BeiDou, Galileo, WIFI or WIMAX. In an embodiment, additional antenna feeds if included may be configured for frequency bands corresponding to at least one of: LTE high band, LTE medium band, LTE low band, GPS, GLONASS, BeiDou, Galileo, WIFI or WIMAX. In an embodiment, antenna feed 113' may be configured for frequency bands corresponding to LTE low band and antenna feeds 106' and 107' may be configured for frequency bands corresponding to LTE medium band and/or LTE high band.

In some embodiments illustrated in FIG. 1 to FIG. 7, capacitive components 110, 111 may be configured to reduce electromagnetic coupling between antenna feeds 106, 107 and where included antenna feeds 113 and 114. In some embodiments illustrated in FIG. 8 and FIG. 7, capacitive components 110',111' may be configured to reduce electromagnetic coupling between antenna feeds 106',107' and where included antenna feeds 113' and 114'. In an embodiment, at least one of the capacitance of capacitive components 110,111,110', 111' may be configured to be adjustable. This may enable adjustment, at least in part, of an isolation band between antenna feeds configured on PWB 105. In an embodiment, at least one of the capacitive components 110,111,110', 111', may be electronically adjustable, for example, by using RF switches. This may enable dynamic adjustment and/or switching of an isolation band between antenna feeds configured on PWB 105.

Figure 8:
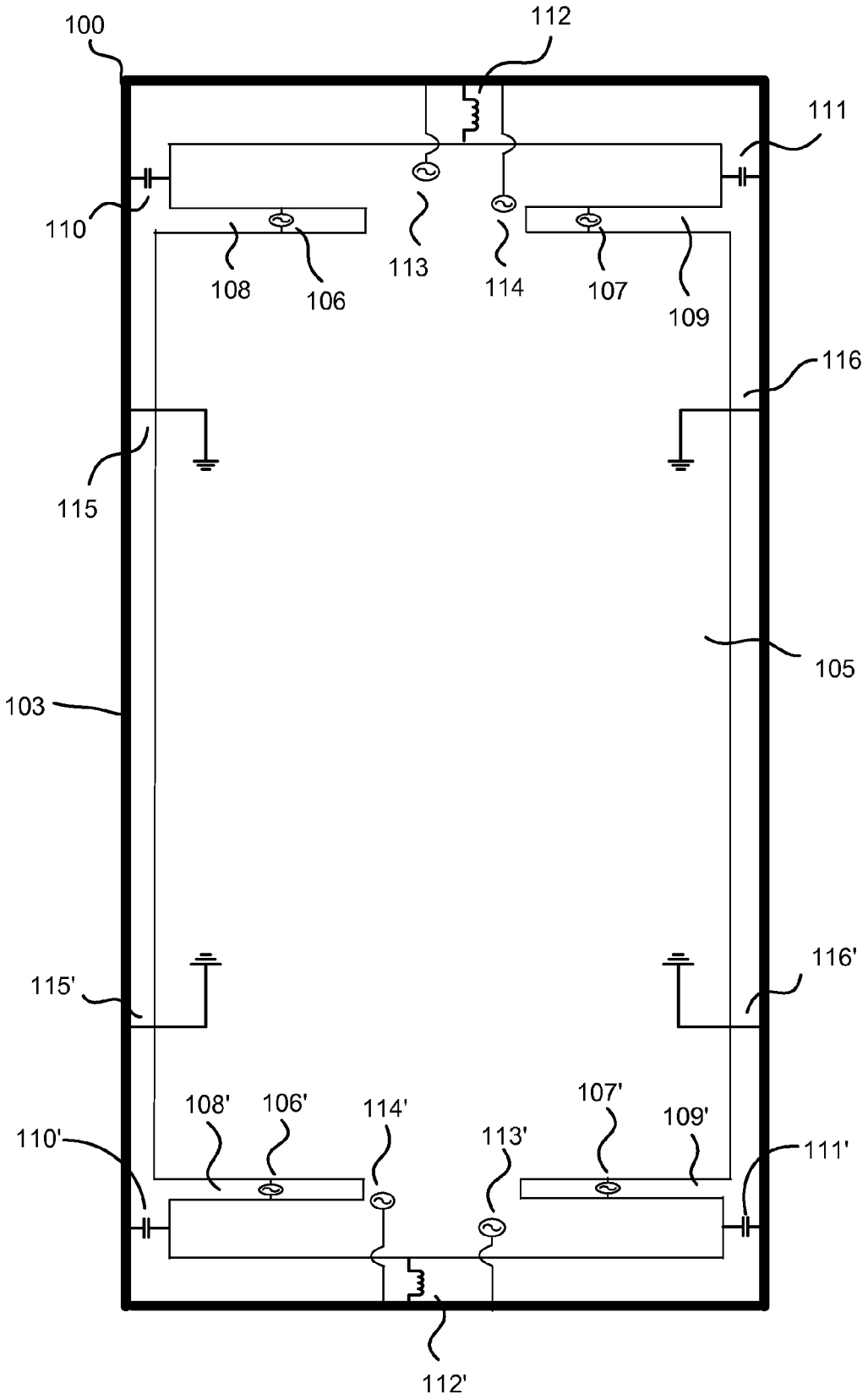
FIG. 8 illustrates a schematic representation of a section of a mobile device comprising a conductive ring around a PWB according to an embodiment.

FIG. 8 illustrates a mobile device according to an embodiment. The embodiment may be similar to the embodiments illustrated with respect to FIG. 6. The device body 103 in FIG. 8 may comprise a conductive ring around the circumference/border of a device 100. A conductive ring may comprise a chassis of a device 100. It may further include at least one of conductive cover portions 101,102 (not illustrated in FIG. 8) which may be configured on the conductive ring on the back side of a device 100. It further includes grounding components configured between a conductive ring and a PWB 105. Grounding components 115,116,115', 116' electrically ground the conductive ring to a PWB 105. The grounding components may be, for example, wiring connects, conductive adhesive, soldered connects, or extensions of either PWB 105 and/or a conductive ring, etc. In an embodiment, at least one of antenna feeds 113,114,106', 107', 113', or 114' may not be included in device 100. In an embodiment, at least one of inductive components 112, 112' may not be included in device 100.

Referring to the illustrations of FIG. 8, a non-conductive gap may be formed between conductive ring and display or a structure supporting the display (not illustrated in FIG. 8). This gap may be segmented into slots by grounding components 115,116,115', 116'. Some of the slots so formed will be adjacent to slots 108, 109, 108', 109' in PWB forming slots with both ends electrically closed. Grounding components 115,116,115', 116' may be configured at a distance from slots 108,109,108', 109' so that the closed end slots so formed have suitable resonance lengths and may act as antennas. In an embodiment, any of grounding components 115,116,115' or 116' may be configured at a distance from the open ends of slots 108,109,108', 109' respectively so as to form suitable resonance lengths for corresponding antenna feeds. The said distance depend upon, among other factors, the operating frequency of the corresponding antenna feed 106,107,106' or 107'. According to an embodiment, the distance of grounding components 115, 116,115', 116' from open ends of slots 108,109,108', 109' respectively may further depend upon the operating frequencies of antenna feeds 113, 114, 113', 114'.

In embodiments which comprise at least one inductive component 112 and/or 112', at least one inductive component 112 and/or 112', may be configured to reduce or contribute to reduce electromagnetic coupling between various antenna feeds configured on PWB 105. In some embodiments, inductance of inductive component 112 and/or 112' may be configured to be adjustable, physically or electronically, to enable adjustment, at least in part, of an isolation band between antenna feeds configured on PWB 105.

Figure 9:
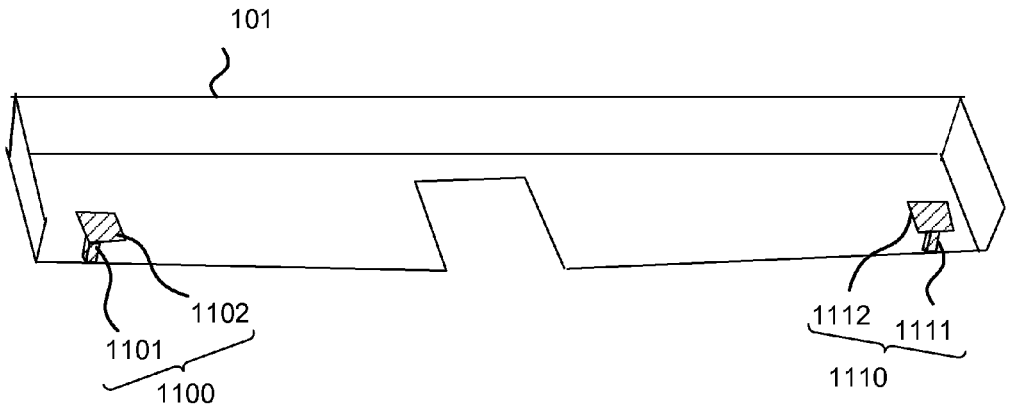
FIG. 9, FIG. 10 and FIG. 11 illustrate schematic representations of a capacitive component of a mobile device according to an embodiment.

FIG. 9 illustrates a conductive cover portion 101 according to an embodiment. The conductive cover portion may comprise structural components/extensions 1100 and 1110 which comprise a part or whole of capacitive components 110, 111. A structural component 1100 may comprise of a stalk 1101 to support a plate 1102. In an embodiment, stalks 1101, 1111 may configured near or on lateral edges of a PWB 105. In an embodiment, at least one of stalks 1101, 1111 may be configured perpendicular to a PWB 105. In another embodiment, at least one of stalks 1101, 1111 may be configured parallel to a PWB 105 on the edges of the PWB 105.

Figure 10:
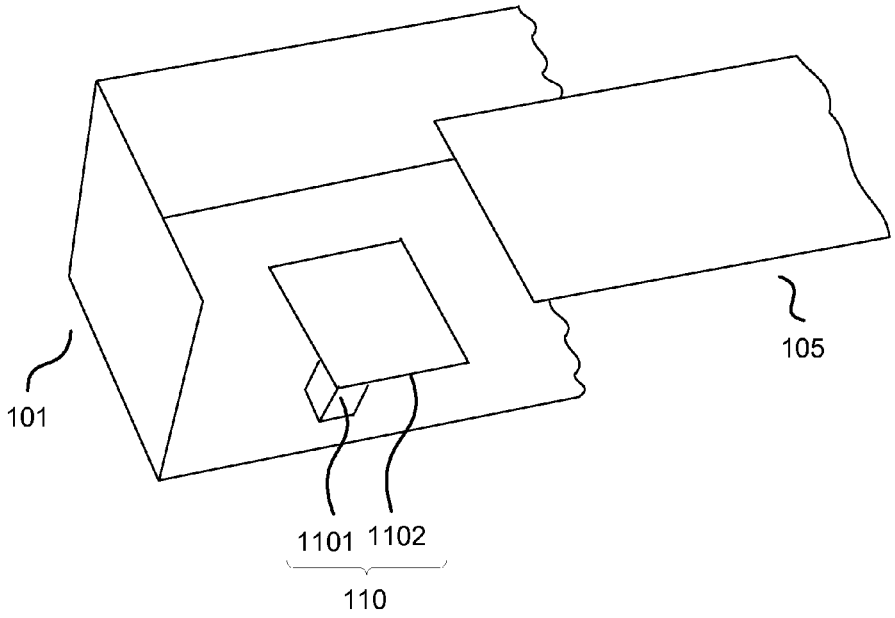

FIG. 10 illustrates a capacitive component 110 according to an embodiment. The capacitive component 110 may comprise structural extensions of a conductive cover portion 101. A stalk 1101 protruding from the conductive cover portion 101 may support a plate 1102. A plate 1102 may comprise a single layer of conductive material or a conductive layer and a dielectric layer or a dielectric layer sandwiched between two conductive layers. The plate 1102 may be configured to make contact with the PWB 105 when the device is assembled for use. According to an embodiment, a location on PWB 105 where plate 1102 makes contact may comprise a dielectric layer configured on a conductive surface in case plate 1102 comprises a conductive layer and only a conductive contact surface in case plate comprises a layer of dielectric material in addition to one or more layers of conductive material. According to an embodiment, stalk 1101 may be a lamellar structure and plate 1102 may be formed by bending the stalk.

Figure 11:
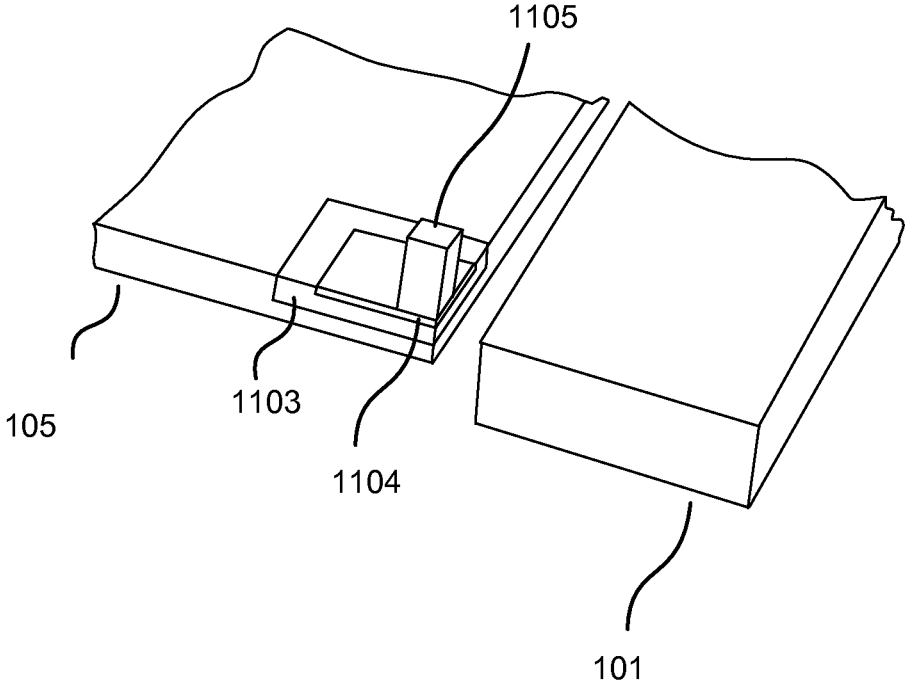

FIG. 11 illustrates a capacitive component 110 according to an embodiment. It comprises a layer of dielectric 1103 configured on a PWB 105. A conductive plate 1104 is configured over the dielectric layer. Further, a conductive stalk 1105 may be configured on a conductive plate 1104 so as to electrically connect the capacitive component with a conductive cover portion 101 when the device is assembled.

Referring to embodiments illustrated in FIG. 1 to FIG. 11, in an embodiment, capacitive components 110, 111 may comprise RF switches (not illustrated). In an embodiment, the inductive component 112 may comprise an RF switch. In an embodiment, RF switches may be configured to change the capacitance values of capacitive components 110,111. In an embodiment, RF switches may be configured to change the inductance of inductive component 112.

It should be noted that FIGS. 1 to 11 are for illustrative purposes only and any dimensions or relative sizes so illustrated are for representative purposes only and should not be construed as limitations. Further it should be noted that some or all the components illustrated in FIGS. 1 to 10 may not be to scale.

The term 'computer', 'computing-based device', 'apparatus' or 'mobile apparatus' is used herein to refer to any device with processing capability such that it can execute instructions. Such processing capabilities are incorporated into many different devices.

Figure 12:
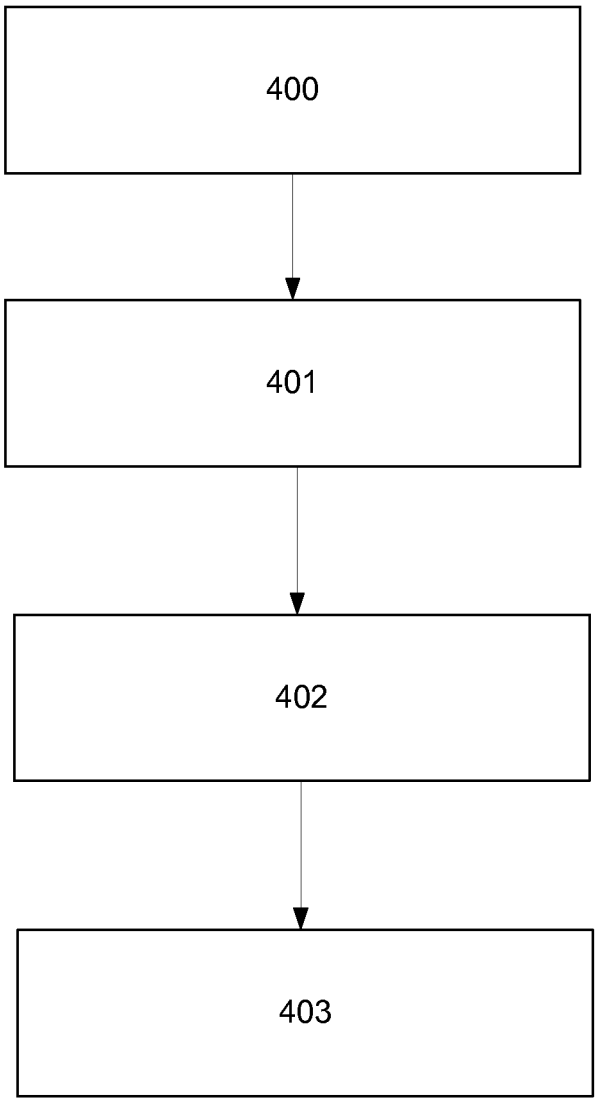
FIG. 12 illustrates a manufacturing process, in accordance with an illustrative embodiment.

An embodiment of a manufacturing process for manufacturing the device 100 is illustrated in FIG. 12.

According to an embodiment, a method comprises the following steps. In step 400, a conductive cover portion 101 is configured on a PWB 105. An antenna feed 106 being configured for one radio frequency and another antenna feed 107 being configured for another radio frequency. In step 401, a capacitive component 110 is configured between a conductive cover portion 101 and a PWB 105. In an embodiment, the capacitive component 110 may be configured at an edge of a PWB 105. In step 401, another capacitive component 111 may be configured between a PWB 105 and a conductive cover portion 101.

According to an embodiment, a method comprises the following steps. In step 400, a conductive cover portion 101 is configured on a PWB 105. The PWB 105 comprising at least two slots 108, 109 and at least two antenna feeds 106 and 107 feeds coupled to the said at least two slots 108, 109. PWB 105 further comprising at least one additional antenna feed 113. An antenna feed 106 being configured for one radio frequency and another antenna feed 107 being configured for another radio frequency. At least one additional feed 113 being configured for an additional frequency band. In step 401, a capacitive component 110 is configured between a conductive cover portion 101 and a PWB 105. In an embodiment, the capacitive component 110 may be configured at an edge of a PWB 105. In step 401, another capacitive component 111 is configured between a PWB 105 and a conductive cover portion 101.

According to another embodiment, a method comprises the steps 400, 401 and 402 as disclosed in the previous embodiments, and further includes a step 403. In step 403 an inductive component 112 is configured between a PWB 105 and a conductive cover portion. In an embodiment, an inductive component 112 is configured on an edge of a PWB 105 which is antipodal to slots 108,109 of a PWB 105. In an embodiment, an inductive component 105 is configured substantially in the middle of an edge of a PWB 105. The edge being antipodal to slots 108, 109 of a PWB 105.

The manufacturing methods and functionalities described herein may be operated by software in machine readable form on a tangible storage medium e.g. in the form of a computer program comprising computer program code means adapted to perform all the functions and the steps of any of the methods described herein when the program is run on a computer and where the computer program may be embodied on a computer readable medium. Examples of tangible storage media include computer storage devices comprising computer-readable media such as disks, thumb drives, memory etc. and do not include propagated signals. Propagated signals may be present in a tangible storage medium, but propagated signals per se are not examples of tangible storage media. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

Any range or device value given herein may be extended or altered without losing the effect sought. Also any example may be combined to another example unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as embodiments of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the embodiments described above may be combined with aspects of any of the other embodiments described to form further embodiments without losing the effect sought, or without extending beyond the disclosure.

The term 'comprising' is used herein to mean including the method, blocks or elements identified, but that such blocks or elements do not comprise an exclusive list and a method or apparatus may contain additional blocks or elements.

According to an embodiment a device, comprising: a conductive portion of a cover of the device; a first antenna feed configured to a first radio frequency band; a second antenna feed configured to a second radio frequency band; at least two slots of a printed wiring board, feeds being coupled to the slots and slots being coupled to the conductive portion; a first capacitive component; and a second capacitive component; wherein the first and the second capacitive component are configured between the printed wiring board and the conductive portion.

According to or in addition to above embodiment, the first and the second capacitive components are configured to reduce an electromagnetic coupling between the first antenna feed and the second antenna feed.

According to or in addition to above embodiment, the conductive portion of a cover of the device comprises an end cap.

According to or in addition to above embodiment, the capacitive components are configured at substantially lateral positions of the printed wire board.

According to or in addition to above embodiment, the printed wire board slots comprise a dual slot T-shape.

According to or in addition to above embodiment, further comprising a cover including a conductive ring wherein, the conductive ring is grounded or electrically shorted with the printed wire board at a distance from each slot, in a position opposing the capacitive components across the slot.

According to or in addition to above embodiment, at least one of the capacitive components comprises a radio frequency switch.

According to or in addition to above embodiment, the capacitance of the at least one of the capacitive components is dynamically adjustable.

According to or in addition to above embodiment, at least one of the capacitive components is a discrete electrical capacitor.

According to or in addition to above embodiment, at least one of the capacitive components comprises structural elements of either the conductive cover or the printed wire board or both.

According to or in addition to above embodiment, at least one of the capacitive components comprises a discrete component and at least one structural element of the conductive cover portion or the printed wire board.

According to or in addition to above embodiment, further including an inductive component configured between the printed wire board and the conductive portion.

According to or in addition to above embodiment, the inductive component is configured substantially in the middle of an edge of the printed wire board.

According to or in addition to above embodiment, at least one of the antenna feeds is configured for a frequency range suitable for Long Term Evolution High Band or Long Term Evolution Medium Band.

According to or in addition to above embodiment, further including at least one additional antenna feed configured to an additional frequency band.

According to or in addition to above embodiment, the at least one additional feed is galvanically coupled with a portion of the conductive cover of the device.

According to or in addition to above embodiment, the at least one additional antenna feed is configured for a frequency range suitable for at least one of: Long Term Evolution Wideband Low Band, Global Navigation Satellite System, Global Positioning System, BeiDou Satellite Navigation System, or a non-cellular wireless system.

According to or in addition to above embodiment, the at least one additional feed is configured substantially close to a longitudinal axis of the printed wire board.

According to an embodiment, a device, comprising: at least two conductive portions of a cover of the device; corresponding to each conductive portion, there being: a first antenna feed configured to a first radio frequency band; a second antenna feed configured to a second radio frequency band; at least two slots on a printed wiring board, the feeds being coupled to the slots and the slots being coupled to the conductive portion; a first capacitive component; and a second capacitive component; wherein the first and the second capacitive component are configured between the printed wiring board and the conductive portion at lateral positions of the printed wiring board.

According to an embodiment, a method comprising: placing a conductive portion cover over a printed wiring board, the printed wiring board including: a first antenna feed configured to a first radio frequency; a second antenna feed configured to a second radio frequency; at least two slots on the printed wiring board; coupling the antenna feeds to the slots on the printed wiring board; configuring a first capacitive element between the printed wiring board and the conductive portion of the cover; and configuring a second capacitive element between the printed wiring board and the conductive portion of the cover.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A device, comprising:

a conductive portion of a cover of the device;

a first antenna feed configured to a first radio frequency band;

a second antenna feed configured to a second radio frequency band;

at least two slots of a printed wiring board, the first antenna feed and the second antenna feed being coupled to the at least two slots and the at least two slots being coupled to the conductive portion;

a first capacitive component coupled to the printed wiring board and a first side of the conductive portion; and a second capacitive component coupled to the printed wiring board and a second side of the conductive portion that is opposite the first side;

wherein the first and the second capacitive components are positioned between the printed wiring board and the conductive portion.

2. The device of claim 1, wherein the first and the second capacitive components are configured to reduce an electromagnetic coupling between the first antenna feed and the second antenna feed.

3. The device of claim 1, wherein the conductive portion of a cover of the device comprises an end cap.

4. The device of claim 1, wherein the capacitive components are configured at substantially lateral positions of the printed wire board.

5. The device of claim 1, wherein the printed wire board slots comprise a dual slot T-shape.

6. The device of claim 1, further comprising a cover including a conductive ring wherein, the conductive ring is grounded or electrically shorted with the printed wire board at a distance from at least one of the at least two slots in a position opposing the capacitive components across the slot.

7. The device of claim 1, wherein at least one of the capacitive components comprises a radio frequency switch.

8. The device of claim 1, wherein the capacitance of the at least one of the capacitive components is dynamically adjustable.

9. The device of claim 1, wherein at least one of the first and second capacitive components is a discrete electrical capacitor.

10. The device of claim 1, wherein at least one of the first and second capacitive components comprises structural elements of either the conductive cover or the printed wire board or both.

11. The device of claim 1, wherein at least one of the first and second capacitive components comprises a discrete component and at least one structural element of the conductive cover portion or the printed wire board.

12. The device of claim 1, further including an inductive component configured between the printed wire board and the conductive portion.

13. The device of claim 12, wherein the inductive component is configured substantially in the middle of an edge of the printed wire board.

14. The device of claim 1, wherein at least one of the antenna feeds is configured for a frequency range suitable for Long Term Evolution High Band or Long Term Evolution Medium Band.

15. The device of claim 1, further including at least one additional antenna feed configured to an additional frequency band.

16. The device of claim 15, wherein the at least one additional feed is galvanically coupled with a portion of the conductive cover of the device.

17. The device of claim 15, wherein the at least one additional antenna feed is configured for a frequency range suitable for at least one of: Long Term Evolution Wideband Low Band, Global Navigation Satellite System, Global Positioning System, BeiDou Satellite Navigation System, or a non-cellular wireless system.

18. The device of claim 15, wherein the at least one additional feed is configured substantially close to a longitudinal axis of the printed wire board.

19. A device, comprising:

at least two conductive portions of a cover of the device;

a first antenna feed configured to a first radio frequency band;

a second antenna feed configured to a second radio frequency band;

at least two slots on a printed wiring board, the first antenna feed and the second antenna feed being coupled to the at least two slots and the at least two slots being coupled to the conductive portion;

a first capacitive component; and a second capacitive component;

wherein the first capacitive component and the second capacitive component are configured between the printed wiring board and the conductive portion at opposite sides of the at least two conductive portions of the cover.

20. A method comprising:

placing a conductive portion cover over a printed wiring board, the printed wiring board including:

a first antenna feed configured to a first radio frequency, a second antenna feed configured to a second radio frequency, and at least two slots on the printed wiring board;

coupling the antenna feeds to the at least two slots on the printed wiring board;

configuring a first capacitive element between the printed wiring board and the conductive portion of the cover on a first side of the cover; and configuring a second capacitive element between the printed wiring board and the conductive portion of the cover on a second side of the cover that is opposite the first side.

* * * * *